US005236301A

United States Patent [19]

Palmer

[11] Patent Number: 5,236,301

[45] Date of Patent: Aug. 17, 1993

[54] CENTRIFUGAL COMPRESSOR

[75] Inventor: Donald L. Palmer, Cave Creek, Ariz.

[73] Assignee: Allied-Signal Inc., Morris Township, Morris County, N.J.

[21] Appl. No.: 812,674

[22] Filed: Dec. 23, 1991

[51] Int. Cl.[5] ..... F04D 29/44

[52] U.S. Cl. ..... 415/116; 415/144; 415/165; 415/186; 415/208.3

[58] Field of Search ..... 415/115, 116, 144, 165, 415/186, 208.2, 208.3, 211.1

[56] References Cited

U.S. PATENT DOCUMENTS

| | | | |
|---|---|---|---|
| 2,405,282 | 2/1938 | Birmann | 415/167 |
| 3,217,655 | 11/1965 | Sercy et al. | 415/116 |
| 3,462,071 | 8/1969 | Garve | 415/116 |
| 3,887,295 | 6/1975 | Yu | 415/116 |
| 4,248,566 | 2/1981 | Chapman et al. | 415/26 |
| 4,479,755 | 10/1984 | Skoe | 415/119 |
| 4,743,161 | 5/1988 | Fisher et al. | 415/58.4 |
| 4,781,530 | 11/1988 | Lauterbach et al. | 415/173.1 |

FOREIGN PATENT DOCUMENTS

| | | | |
|---|---|---|---|
| CP-282 | 5/1980 | Belgium . | |
| 1308415 | 9/1962 | France | 415/116 |
| 273364 | 10/1970 | U.S.S.R. . | |
| 591619 | 4/1978 | U.S.S.R. . | |
| 1132485 | 11/1968 | United Kingdom . | |

*Primary Examiner*—Edward K. Look
*Assistant Examiner*—Michael S. Lee
*Attorney, Agent, or Firm*—James W. McFarland; Robert A. Walsh

[57] ABSTRACT

An improved centrifugal compressor for use in gas turbine engines includes a secondary air flow inlet in the compressor shroud at a location downstream of the inducer, with passive elements in the secondary air inlet for effectively preventing flow out of the secondary air inlet from the compressor impeller at part speed design operation, while augmenting and enhancing flow of secondary air flow into the compressor impeller at maximum design speed operation of the compressor impeller.

12 Claims, 2 Drawing Sheets

CENTRIFUGAL COMPRESSOR

CROSS-REFERENCE TO RELATED APPLICATION

Similar subject matter is discussed in my commonly assigned, copending patent application Ser. No. 813,241 entitled Vaned Shroud for Centrifugal Compressor, filed simultaneously herewith and incorporated herein by reference.

TECHNICAL FIELD

This invention pertains to centrifugal compressors as they may be utilized in gas turbomachinery such as gas turbine engines, and relates more particularly to improvements therein for enhancing compressor operation at separate design points of operation.

BACKGROUND OF THE INVENTION

Centrifugal compressors are often used in gas turbomachinery to compress and direct a pressurized air or gas flow to the gasifier section in a gas turbine engine. In the gasifier section a combustion process dramatically heats the gas flow which is then exhausted across one or more turbine stages to create rotational mechanical power and/or thrust through exhaust of the gas flow. Great care must be taken in the design and configuration of such centrifugal compressors to provide sufficient operation at the desired power speed while avoiding surge or stall of the compressor. Characteristically, the surge margin for compressors is an important criteria in their design and operation.

Many applications of modern gas turbomachinery such as gas turbine engines may optimally require operation of the compressor at two different design points, one point being the normal full power setting for the engine and a second, part speed design point, for lower power or cruise operations. The purpose of operating at two different design points is one of efficiency and minimization of the specific fuel consumption of the engine when considering its entire design operational envelope.

Difficulties are recognized in providing a compressor with such dual design point operation inasmuch as the compressor obviously must be designed to produce adequate flow at the required high speed or full power condition. When such compressor is then operated at reduced speed and power conditions the impeller blade leading edge will be operating at high incidence angles relative to the air intake. This tends to create considerable pressure losses at the part-power operation due to these high incidence angles, and also greatly reduces the surge margin of the centrifugal compressor when operating at this part-power design point.

Various prior configurations are known which attempt to take advantage of the known "pressure reversal" which occurs at a downstream point on the compressor impeller when operating at either the part speed or full speed design points. Examples include U.S. Pat. Nos. 4,248,566 and 2,405,282.

SUMMARY OF THE INVENTION

It is an important object of the present invention to provide an improved centrifugal compressor of the class described wherein a secondary air inlet flow to the compressor is disposed slightly downstream from the primary air intake to the compressor. Importantly, passive elements, i.e. nonmoving elements, are included at this secondary inlet to promote secondary air inlet flow into the impeller at maximum power conditions, while simultaneously discouraging and preventing exhaust flow out of the compressor through the secondary opening when operating at part speed operations.

More particularly, the present invention contemplates a plurality of vanes traversing the secondary inlet and highly angled in the direction of rotation of the compressor impeller. Rotation of the compressor impeller thereupon induces increased secondary air inlet flow into the impeller at maximum power conditions, while a tortuous flow path is presented for reverse flow attempting to flow out of the compressor through the secondary inlet when the compressor is at part speed operation.

Another important object of the present invention is to provide an improved compressor impeller designed to operate at two separate design speeds, wherein the forward impeller section of the compressor is deliberately designed to maintain maximum compressor efficiency at a part speed operational design point, and wherein a secondary air inlet of the class described augments the inlet air flow to the compressor to provide optimal operation when operating at maximum power design point.

These and other objects and advantages of the present invention are specifically set forth in or will become apparent from the following detailed description of preferred arrangements of the invention, when read in conjunction with the accompanying drawings.

DETAILED DESCRIPTION OF THE PREFERRED EMBODIMENT

Figure 1:
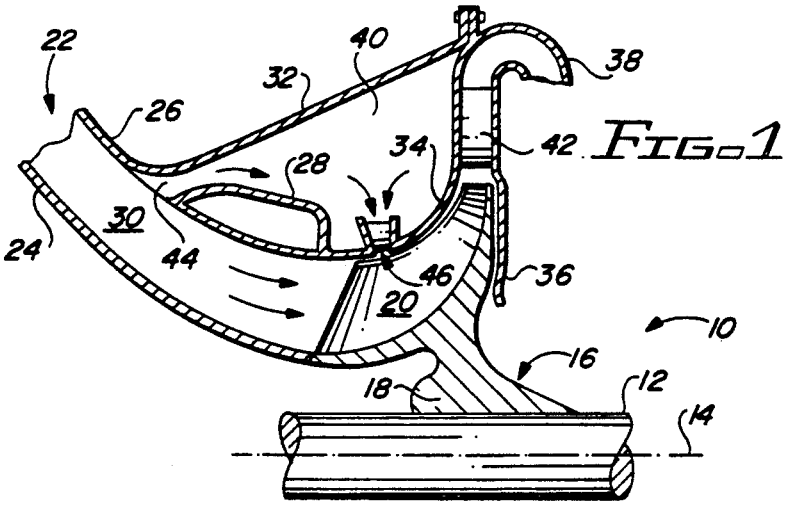
FIG. 1 is a partial, meridional cross sectional view of a portion of a gas turbine engine utilizing a centrifugal compressor of the present invention.

Referring now more particularly to the drawings, a portion of a gas turbine engine 10 illustrated in FIG. 1 includes a high speed rotary shaft 12 rotatable about an axis 14 for driving a centrifugal compressor impeller 16 attached thereto. Impeller 16 conventionally includes a hub portion 18 and a plurality of impeller blades 20 which extend generally radially outwardly from the blade. The engine further includes a casing generally referred to by the numeral 22 of which a variety of components are illustrated. More particularly the casing 22 includes components 24, 26 and 28, generally referred to herein as the front frame, which define an annular inlet duct 30 through which the primary air flow or gas flow is directed to be received at the compressor. The casing further includes an element 32, a compressor shroud 34, and additional compressor casing elements 36, 38. Shroud 34 is disposed closely adjacent the radial outer tips of all of the impeller blades 20. As apparent in FIG. 1 the casing components 32, 28 and shroud 34 combine to define a closed chamber 40 of annular configuration disposed radially exteriorly of the shroud 34 and extending circumferentially around the compressor impeller 16.

Conventionally, the radially directed, compressed gas exiting the compressor impeller 16 radially outwardly is directed across diffuser vanes 42 into a diffusion section prior to delivery to either the next stage compressor or to the combustor of a gas turbine engine.

Chamber 40 is closed except for first and second openings 44, 46. First inlet opening 44 allows communication of the closed chamber 40 with the intake duct 30 at a location substantially upstream from the compressor leading edge 48. Additionally the closed chamber can communicate directly with the compressor impeller through second opening 46 which is described in greater detail below. The second inlet opening 46 is disposed as a preselected location downstream from the leading edge 48 of the compressor impeller, and located more particularly at a position wherein pressure reversal occurs dependent upon whether the compressor impeller is operating at a part speed design point or a maximum speed design point. This phenomena of pressure reversal is itself known and discussed in various references such as Chapman U.S. Pat. No. 4,248,566. Location of the opening 46 is more critical in enhancing supplementary air inlet flow.

Figure 2:
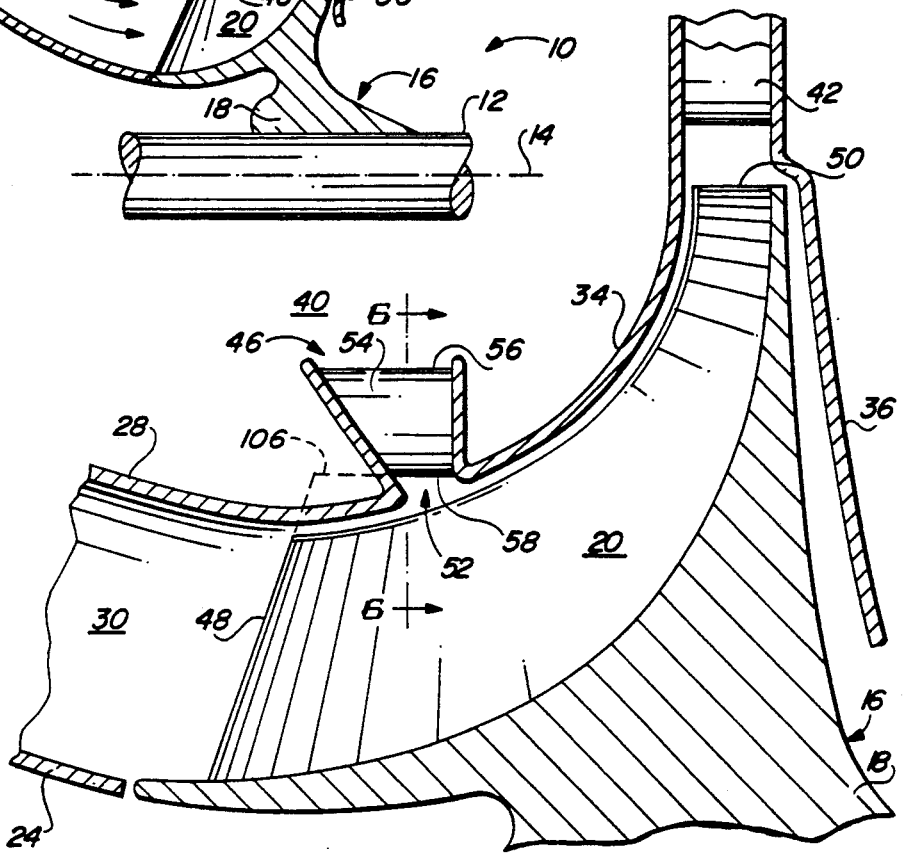
FIG. 2 is an enlarged partial cross sectional view similar to FIG. 1 but showing further details of construction.
Figure 6:
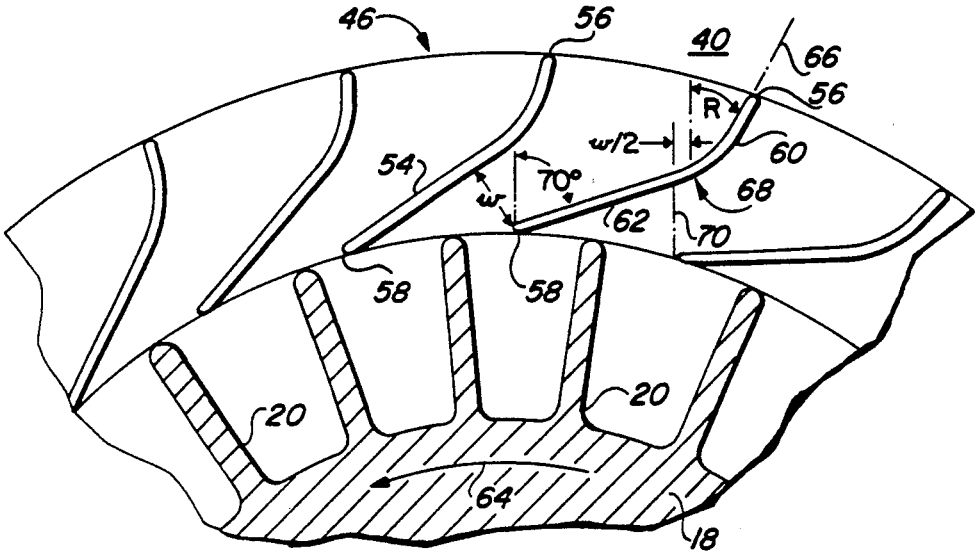
FIG. 6 is a plan cross sectional view of a portion of the compressor and associated secondary inlet as viewed along lines 6—6 of FIG. 2.

As illustrated in FIGS. 2 and 6 the centrifugal compressor impeller includes impeller blades 20 having a forward inducer portion extending downstream from the inducer inlet leading edge 48 of each impeller blade. This entry inducer section extends somewhat generally axially before the airflow being compressed begins to turn radially outwardly before ultimately being delivered in a compressed state in a generally radially outward direction at the exit end 50 of the compressor impeller blades.

An important aspect of proper operation of a compressor impeller is the control of the angle of incidence of the air inlet flow from inlet 30 onto the leading edge 48. This angle of incidence is the relative angle between the blade and the air direction at the blade leading edge 48. By convention a positive sign for the angle of incidence denotes that the angle of the incoming air is higher than the angle of the leading edge of the blade, while negative angle of incidence occurs when the air angle is less than the blade angle. Excessive or high incidence angles on the blade leading edge are generally undesirable in that considerable pressure losses may be generated reducing the efficiency potential of the compressor. On the other hand, too high of negative leading edge incidence angles may induce very low pressures in the inducer section of the compressor which limits the total air flow and thus power of the engine. Typically, the compressor impeller blades 20 may be tangentially curved along at least a portion of their axial length to provide optimal compressor operation, as well known to those skilled in the art.

The present invention contemplates an improved secondary air inlet 46 to the compressor impeller 16 and generally includes a somewhat continuous annular slot 52 in the shroud 34 which extends annularly around the circumference of the impeller blades 20. Extending transversely across the secondary opening 46 are a plurality of slanted vanes 54. Vanes 54 each have a leading edge 56 at the radially outer periphery thereof most adjacent to the internal chamber 40, and a trailing edge 58 disposed closely adjacent the tips of the impeller blades 20. In the configuration of the slanted vanes 54 illustrated in FIG. 6, each vane 54 has a radially outer circular arc segment 60 and a radially inner linear or straight segment 62. Importantly, the straight segment 62 is highly angled relative to the direction of rotation of the compressor impeller as illustrated by the arrow 64 in FIG. 6. Each of the straight segments 62 are slanted in the direction of rotation of the compressor impeller. The circular arc segment smoothly blends to the straight line segment 62, and the leading edge 56 at the end of the circular arc segment 60 is in general alignment with a radial line such as line 66 illustrated in FIG. 6. This configuration assures that incoming secondary air flow from closed chamber 40 may enter directly radially inwardly into the secondary opening 46 but is then turned and angled so as to enter the compressor impeller in a direction substantially tangential to the direction of rotation thereof. For example, in the arrangement illustrated in FIG. 6 the straight line segments at the trailing edge 58 are disposed at a severe angle of approximately 70 degrees from a radial line. For exemplary purposes, it is noted that the circular arc section 60 smoothly blends with the straight segment 62 at a point 68 which is displaced radially outwardly a distance "w/2" from the throat line 70 between that particular vane and the leading edge of the next succeeding blade, wherein the distance "w" is the throat or minimum distance from vane to vane. Such geometric arrangement is found to produce a meridional velocity of augmented secondary air flow being received through secondary inlet 46 of nearly 20% of the meridional velocity of the air flow being carried at that location within the impeller. Thus, this configuration preswirls the secondary inlet flow dramatically to strongly enhance secondary inlet flow through opening 46 into the impeller at full power design operation.

Figure 3:
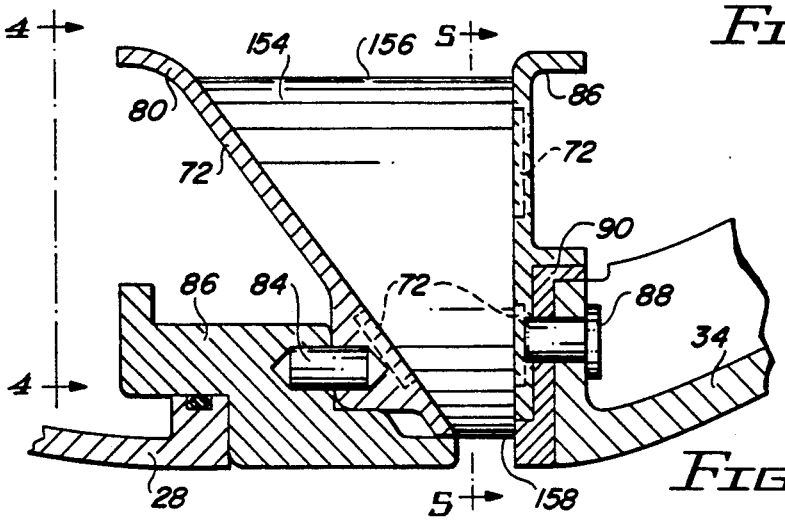
FIG. 3 is a further enlarged view of the secondary air inlet showing further details of construction of another configuration for the air inlet.
Figure 4:
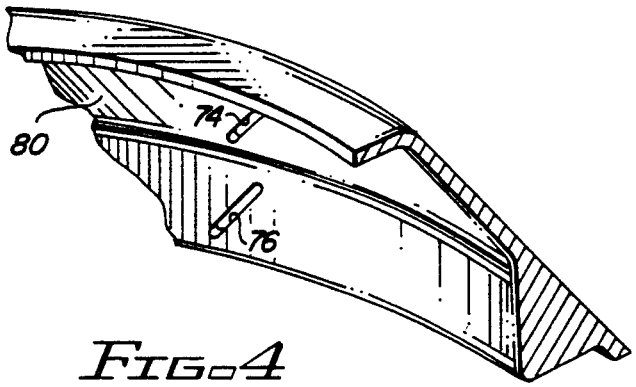
FIG. 4 is a front plan view of the secondary inlet front plate as viewed along lines 4—4 of FIG. 3.
Figure 5:
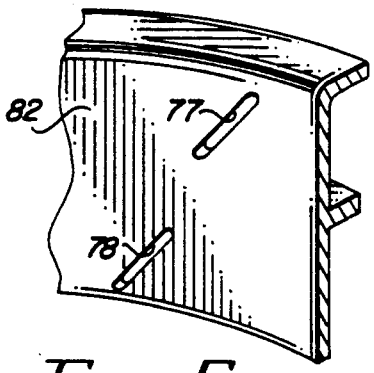
FIG. 5 is a plan view of the rear plate as viewed along lines 5—5 of FIG. 3 but with the vane deleted for clarity of illustration.

The arrangement of FIG. 2 and 6 may include slanted vanes which are integrally cast with the associated casing, or a vane 154 constructed as illustrated in FIG. 3. The vane 154 is smoothly contoured and angled such as illustrated in FIG. 6 from a radially outer leading edge 156 to a radially inner trailing edge 158. The vane 154 may be conveniently constructed with tangs 72 (illustrated in dashed lines in FIG. 3) at the opposite axial edges thereof for insertion into complementary slots 74, 76, 77 and 78 in an axially angled front plate 80 and radially extending rear plate 82 as illustrated in FIGS. 4 and 5. The tangs 72 of vane 154 may be brazed within the slots 74–78 for intersecurement therewith. Front plate 80 is secured via straight pins 84 and a front spacer 86 to the front frame segment 28. The rear plate 82 is affixed to the shroud 34 through a plurality of header pins 88 and an aft spacer 90. It will be noted that the slanted vanes are preferably constructed with a tapered configuration in an axial direction such that the axial length of the outer leading edge 156 is substantially longer than the axial length of the trailing edge 158. This further promotes inducement of a higher volume of secondary air inflow into the compressor impeller at maximum design point operation. It is important that the trailing edge 158 of FIG. 3, or the equivalent trailing edge 58 of FIG. 6, be located very closely to the outer tips of the impeller blades 20 so as to minimize fluid flow between adjacent spaces defined between impeller blades 20 through the secondary air flow inlet. For purposes of clarity in the drawings, exaggerated space is illustrated between the slanted vane trailing edge and the outer tip of the impeller blades.

Figure 7:
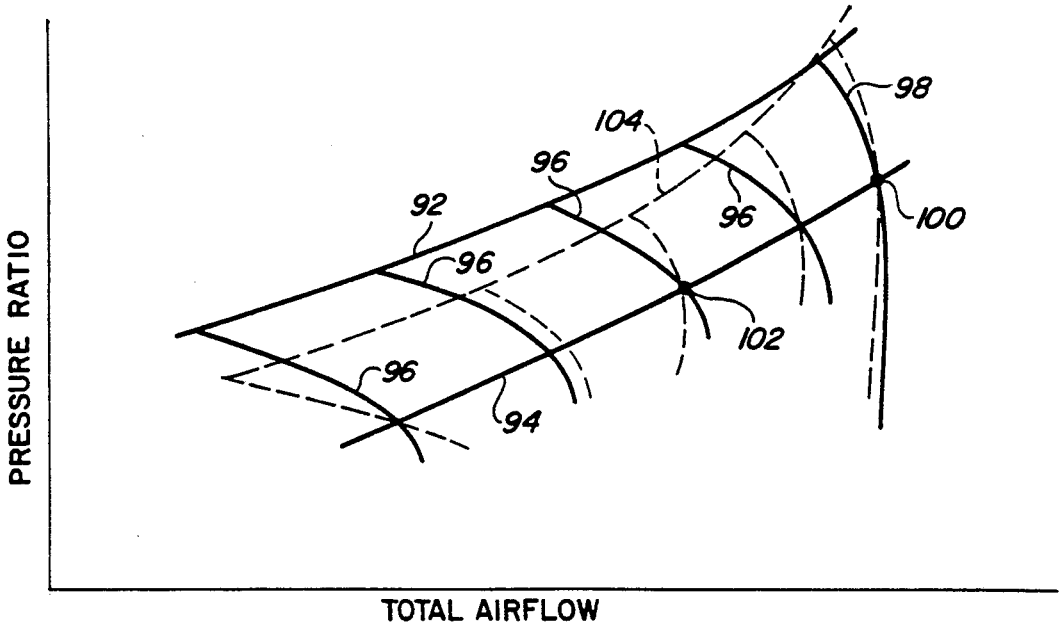
FIG. 7 is a compressor map illustrating the operational advantages of the present invention in comparison to normal compressor designs.

Operation of the present invention can be most readily understood by reference to the compressor map illustrated in FIG. 7. FIG. 7 is a plot of compressor ratio versus total air flow mass passing through the compressor, and characteristically includes a surge line 92 representative of the limits of stable compressor operation. That is, to the left and above surge line 92 the compressor experiences surge or stall and becomes inoperative from a practical standpoint. Line 94 represents a typical steady state operating line for a centrifugal compressor. Operation of the compressor in a condition between lines 94 and 92 creates compressor impeller acceleration, while operation below line 94 causes compressor deceleration. A plurality of lines of constant compressor speed are illustrated by 96 and are typically expressed in a normalized manner as percentages of maximum design speed. Thus, the rightmost line of constant speed 98 represents one-hundred percent or maximum power design operational speed of the compressor impeller. Point one-hundred illustrates steady state compressor operation at one-hundred percent design speed while point 102 is representative of a part speed design point. The part speed design point may typically be somewhere between 85 percent and 95 percent of maximum design speed.

For purposes of comparison, FIG. 7 includes dash lines 104 presenting an exemplary compressor map of a compressor not including the present invention, but designed to operate at both the maximum power design point 100 and the part speed design point 102. From FIG. 7 one clear advantage offered by the present invention is illustrated. More particularly the surge margin of the present invention offers a significant improvement in comparison to prior art structures at the part speed design point. Surge margin is, of course graphically illustrated in FIG. 7 as the distance between the steady state line 94 and the surge line 92.

In operation, at the maximum design and power speed point for the compressor, air inlet flow from inlet 30 may be entering the leading edge at a less than desirable incidence angle resulting in a reduced pressure area in the inducer portion of the compressor. Augmented secondary air inlet flow passes through the slanted vanes into the compressor impeller. This augmented air flow thereby assures that the compressor has sufficient total air flow to operate at the 100 percent design speed operation. The highly slanted angle of the vanes 54 assures that this secondary flow into the compressor impeller is enhanced. Additionally, configuring the first opening 44 to be facing the direction of inlet flow in inlet 30 allows the dynamic pressure head in inlet 30 to further enhance secondary flow into chamber 40 and thence through the second opening 46.

While operating at part speed design point 102, the compressor impeller is rotating at a lower speed with a higher incidence angle at the leading edge 48 thereof. However, the slanted configuration of the vanes 54 strongly discourages and minimizes reverse fluid flow out of the compressor impeller through the secondary opening 46 to the closed chamber 40. This is true because, even though pressure at the opening 52 is now higher than that in the closed chamber 40, the slanted vanes 54 present a highly tortuous path for fluid flow to pass reversely out of or radially outwardly through the secondary opening 46. To accomplish such exhaust, the air flow must virtually turn almost 180 degrees upon itself in order to exit outwardly through the secondary opening 46. Thus, the tangential component of the air flow being carried between the compressor impeller blades 20 strongly discourages outflow through the secondary opening at the part speed design point. Additionally, since opening 44 opens into inlet 30 in an upstream facing direction, the reverse recirculation outflow is further discouraged.

Elimination of the outflow at the part speed design point has a positive impact in the operational efficiency of the compressor impeller. This is true because air flow out of the compressor, whether bleed flow or by leakage, is undesirable as the energy input already introduced into the air by the compressor is lost, and the engine is unable to produce power from the energy already imparted to that lost air flow. Assuming all other factors constant, such bleed or leakage flow out of the secondary passage 46 would otherwise always increase fuel consumption for a given power level.

The slanted vanes 54 also inhibit blade unloading which occurs by leakage between the interspaces formed between the blade vanes 20 by passing across the tips thereof at the secondary air inlet 46. That is, the slanted vanes 54, being located very closely adjacent the outer tips of the impeller blades 20, minimizes leakage over the blade tips at this location.

Thus, the present invention incorporates the slanted vanes 54, slanted in the direction of rotation of the compressor impeller 16, to both discourage air flow out of the compressor through the secondary air inlet when operating at part design speed when pressure in the compressor impeller is higher than that in the enclosed chamber 40, and to enhance inflow of secondary air flow radially inwardly into the compressor to augment total air flow therein at the 100 percent maximum design point speed.

The advantages of the present invention can be understood in another manner. More particularly, in FIG. 2 a dashed line 106 is included which would be representative of the height of the inducer leading edge of a compressor blade which would be required to provide the same air inlet flow at 100 percent design speed as accomplished by the present invention which incorporates the secondary inlet 46. In other words, the compressor impeller of FIG. 2 is preferably designed such that the inducer portion, and more particularly the leading edge thereof, are designed to produce optimal angles of incidence and relative Mach number at the leading edge when operating at the part speed design point. All of the aerodynamic elements downstream of the inducer section of the compressor are sized for operation at the 100 percent design speed point rather than the part speed design point. By designing the compressor with an inducer section providing optimal performance at the part speed design point, the inducer inlet leading edge is significantly shorter in radial height. Such shorter, stiffer blades are more rugged in configuration and may be fabricated at lower cost.

Importantly, even though the inducer inlet portion of the compressor is designed for optimal operation at the part speed design point rather than the 100 percent speed design point, it is important that the vanes 54 be included so as to discourage and minimize leakage flow out of the compressor impeller when operating at this part speed design point, as discussed in detail above. At the same time, inclusion of the secondary air inlet with its slanted vanes 54 assures the augmented secondary air inlet flow required so that this compressor impeller can still make 100 percent design speed operation even though the inducer inlet portion thereof is designed for optimal operation at part speed design point.

In the foregoing it will be apparent that the present invention provides improved part power engine operation and efficiency because radial outlet flow through secondary inlet 52 is discouraged. Part speed surge margin is significantly improved as illustrated in FIG. 7. This improvement in surge margin, may also be more readily understood by recognizing that the inducer portion of the compressor blade can be ultimately designed for operation at this point 102 on the compressor map. As noted, the configuration allows shorter and more rugged and less expensive configuration of the impeller blades themselves.

The present invention accomplishes all of these improvements without introduction of mechanical moving parts. That is, the passive device represented by the stationary vanes 54 acts to meter the amount of flow through the slot 52 in a preferential direction without introduction of moving parts.

The foregoing detailed description of preferred arrangements of the invention should be considered exemplary in nature and not as limiting to the scope and spirit of the invention as set forth in the appended claims. For example, the principles of the present invention are useful in compressor configurations, not including a closed chamber 40 but rather with opening 46 communicating with ambient. Additionally, the present invention is useful with second or later stage compressors.

Having described the invention with sufficient clarity that those skilled in the art may make and use it, what is claimed is:

1. A centrifugal gas compressor comprising:

a centrifugal impeller having a forward inducer inlet, a hub, and a plurality of impeller blades extending generally radially from said hub;

a casing including a stationary shroud located closely adjacent to the tips of said impeller blades, said casing defining an inlet duct for delivering primary inlet gas flow to said inducer inlet and defining a chamber disposed radially outwardly of said shroud, said casing having a first opening communicating said chamber with said inlet duct as a location upstream of said inducer inlet and a second opening in said shroud communicating said chamber with said impeller at a preselected location downstream of said inducer inlet; and a plurality of slanted vanes in said second opening, said vanes tangentially slanted in the direction of rotation of said impeller blades to (a) preswirl secondary inlet gas flow flowing from said chamber through said second opening into said impeller at high impeller speeds, and (b) discourage gas flow out of the impeller through said second opening into said chamber, each of said vanes having a radially outer segment formed as a circular arc, and a linear inner segment.

2. A compressor as set forth in claim 1, wherein each of said vanes is smoothly contoured from a radially outer leading edge to a radially inner trailing edge.

3. A compressor as set forth in claim 2, wherein said leading edge of each vane lies on a radial line relative to said impeller and said trailing edge lies on a line at a preselected angle from said radial line in the direction of rotation of said impeller.

4. A compressor as set forth in claim 3, wherein said preselected angle is approximately 70°.

5. A compressor as set forth in claim 1, wherein said preselected location is one wherein a pressure reversal occurs across said second opening between said part-speed and high speed impeller operations.

6. A compressor as set forth in claim 1, wherein other than said first and second openings, said chamber is closed.

7. A compressor as set forth in claim 1, wherein said first opening faces upstream to inlet gas flow in said inlet duct.

8. In a gas turbine engine:

a centrifugal compressor having a forward inducer inlet, a hub, and a plurality of impeller blades extending generally radially from said hub;

a casing defining an inlet duct for delivering primary inlet airflow to the inducer inlet, said casing defining a stationary shroud located closely to the tips of said impeller blades, said casing further defining a chamber having a first opening communicating with said inlet duct upstream of said inducer inlet and a second opening in said shroud at a preselected location downstream of said inducer inlet; and a plurality of slanted vanes disposed in said second opening, said vanes slanted in the direction of rotation of said impeller blades and operable to (a) preswirl airflow flowing from said chamber through said second opening into said compressor at high compressor speeds, and (b) discourage and minimize flow of pressurized air from the compressor through said second opening into said chamber, each of said vanes having a radially outer segment formed as a circular arc, and a linear inner segment.

9. A gas turbine engine as set forth in claim 8, wherein said preselected location is one wherein a pressure reversal occurs across said second opening between said part-speed and high speed impeller operations.

10. A gas turbine engine as set forth in claim 8, wherein said first opening faces upstream relative to the direction of the primary inlet airflow in said inlet duct.

11. A gas turbine engine as set forth in claim 8, wherein each of said vanes is smoothly tangentially contoured from a radially outer leading edge to a radially inner trailing edge.

12. A centrifugal gas compressor comprising:

a centrifugal impeller having a forward inducer inlet, a hub, and a plurality of impeller blades extending generally radially from said hub;

a casing including a stationary shroud located closely adjacent to the tips of said impeller blades, said casing defining an inlet duct for delivering primary inlet gas flow to said inducer inlet and defining an opening the said shroud communicating with said impeller at a preselected location downstream of said inducer inlet; and a plurality of slanted vanes in said opening, said vanes tangentially slanted in the direction of rotation of said impeller blades to preswirl secondary inlet gas flow flowing through said opening into said impeller at high impeller speeds, and (b) discourage gas flow out of the impeller through said opening during part-speed impeller operation, each of said vanes having a radially outer segment formed as a circular arc, and a linear inner segment.

* * * * *